United States Patent [19]

Nakamura et al.

[11] 4,008,104

[45] Feb. 15, 1977

[54] METHOD FOR DEPHOSPHORIZATION AND DENITRIFICATION OF AN ALLOY CONTAINING EASILY OXIDIZABLE COMPONENTS

[75] Inventors: Yasushi Nakamura; Michihisa Itou, both of Tokyo; Takamasa Ohno, Hikari; Hidetake Ishikawa, Kitakyushu, all of Japan

[73] Assignee: Nippon Steel Corporation, Tokyo, Japan

[22] Filed: May 5, 1975

[21] Appl. No.: 574,696

[30] Foreign Application Priority Data

May 9, 1974 Japan ..... 49-50706

[52] U.S. Cl. ..... 148/13.1; 148/23; 148/126

[51] Int. Cl.[2] ..... C21D 1/68; B23K 35/34

[58] Field of Search ..... 75/53–58; 148/26, 13.1

[56] References Cited

UNITED STATES PATENTS

| | | | |
|---|---|---|---|
| 3,383,202 | 5/1968 | Lynch | 75/53 |
| 3,490,958 | 1/1970 | Robinson | 148/13.1 |
| 3,492,114 | 1/1970 | Schneider | 75/53 |
| 3,526,552 | 9/1970 | Church | 148/13.1 |
| 3,716,352 | 2/1973 | Ooi | 75/58 |
| 3,871,868 | 3/1975 | Renaud | 75/53 |
| 3,885,957 | 5/1975 | Richter | 75/53 |

*Primary Examiner*—P. D. Rosenberg
*Attorney, Agent, or Firm*—Watson Leavenworth Kelton & Taggart

[57] ABSTRACT

Cr alloy, Mn alloy or Mo alloy can be dephosphorized and denitrified simultaneously with a flux newly prepared. The flux comprises metallic Ca, Mg, Ba or Sr and halides thereof. There is no loss of valuable alloying component in this method.

6 Claims, No Drawings

METHOD FOR DEPHOSPHORIZATION AND DENITRIFICATION OF AN ALLOY CONTAINING EASILY OXIDIZABLE COMPONENTS

DETAILED DESCRIPTION OF THE INVENTION

This invention relates to a method for effectively and simultaneously removing phosphorus (P) and nitrogen (N) from such alloy as chromium alloy, manganese alloy or molybdenum alloy, etc. including a component or components which may easily be oxidized in the oxidizing refining. The "component or components" is hereinafter referred to as "components".

As well known, there have been many reports given as to the effect of P and N upon the characteristics of an alloy. Most of these reports show that the mechanical and the anti-corrosive properties can be improved remarkably by extremely lowering the content of P and N in such alloy as Cr alloy, Mn alloy and Mo alloy, etc. However, it is by no means easy to lower P and N contents in these alloys since the activity of P and N therein is low. Taking an example by the behavior of P in the production of Cr alloy such as ferro-chrome, the ferro-chrome is usually manufactured in an electric furnace by means of a reducing process using a reducing agent consisting chiefly of carbon or silicon whereby a large part of P in a material is reduced, which is then introduced into a metal produced. Accordingly, it is necessary to use a material having a quite small content of P or to resort to a special process such as an electrolysis process in order to manufacture a ferro-chrome containing little P. As a result, a product thus obtained becomes very expensive. In the usual refining process where it is desired to eliminate P, an oxidizing refining must be conducted in the presence of a basic slag, wherein, in case of the Cr alloy, the oxidation of Cr severely occurs. In this case, if the slag is reduced in an attempt to recover the chromium therefrom, phosphorus is also recovered from the slag. Consequently, the usual refining process is not suitable for the Cr alloy. It means that P in Cr alloy is very difficult to remove by the refining and that there is no effective way for dephosphorization.

Now in case of eliminating N in the manufacture of the Cr alloy, it is also difficult to produce a product of low N content due to some invasion of air in the usual process for producing the Cr alloy. In addition, when it is desired to remove N, it is inevitable to conduct refining under high vacuum condition for a long time or to effect washing by such bubbles as Ar, etc., because the equilibrium solubility of N in the Cr alloy is high. In fact, it is quite difficult to decrease the content of N in the 26% Cr steel to 100 ppm or less in a furnace other than a special refining furnace such as a electron beam furnace.

Also in the case of production of the Mn alloy or Mo alloy, the dephosphorization or denitrification is difficult for the reason similar to that in the case of the Cr alloy. Particularly, Mn is ready to evaporate under high vacuum, and it is thus impossible to effect denitrification of the Mn alloy under such vacuum condition.

As set forth hereinabove, it is very difficult to eliminate P and N from the Cr alloy, Mn alloy and Mo alloy.

It is therefore an object of the invention to provide a new method different from the conventional method whereby P and N are simultaneously removed to produce an alloy having a very low content of P and N.

The inventors of this invention have now found, based on various experiments, that P and N can be removed simultaneously by treatment of an alloy such as Cr alloy, Mn alloy, Mo alloy, etc. including easily oxidizable components by the use of a molten flux which comprises one or more than one member of the group consisting of Ca, Mg, Ba and Sr metals and one or more than one member of the group consisting of calcium halide, magnesium halide, barium halide and strontium halide.

According to this invention, there is provided a method for dephosphorization and denitrification of an alloy containing easily oxidizable components which comprises bringing a flux into contact with an alloy such as Cr alloy, Mn alloy or Mo alloy, etc. which is difficult to dephosphorize and denitrify at temperatures not less than the melting point of said flux but not more than the melting point of said alloy to be dephosphorized and denitrified, said flux containing one or more than one member of the group consisting of Ca, Mg, Ba and Sr metals and one or more than one member of the group consisting of calcium halide, magnesium halide, barium halide and strontium halide.

According to this invention, there is also provided a method for dephosphorization and denitrification of a powdery alloy containing easily oxidizable components which comprises pulverizing an alloy such as Cr alloy, Mn alloy or Mo alloy, etc. which are difficult to dephosphorize and denitrify, and bringing a flux into contact with said pulverized alloy at temperatures not less than the melting point of said flux but not more than the melting point of said pulverized alloy, said flux containing one or more than one member of the group consisting of metallic Ca, Mg, Ba and Sr and one or more than one member of the group consisting of calcium halide, magnesium halide, barium halide and strontium halide.

According to this invention, there is also provided a method for dephosphorization and denitrification of a powdery alloy containing easily oxidizable components which comprizes increasing the temperature of the powdery alloy such as Cr alloy, Mn alloy, Mo alloy, etc. which is difficult to dephosphorize from a temperature range, where the coarsening of the crystal grains does not occur to a temperature which is above the melting point of said flux and is below the melting point of said alloy at a rate of at least 1000° C/15 min., and bringing said flux into contact with said alloy, said alloy having been solidified by rapid cooling from a molten state and having phosphorus segregated in the boundary of the fine crystal grains.

In one preferable embodiment of this invention, a material alloy such as Cr alloy, Mn alloy or Mo alloy, etc., which is readily subjected to severe oxidation of the alloy components in the oxidizing refining process and which is thus difficult to dephosphorize, is first crushed. Alternatively it can be made into powdered condition by, for example, atomizing process after melting. A solid, pulverized alloy can thus be obtained. Then the pulverized alloy is charged into a reaction vessel together with a flux. This flux may be a solid mixture or a molten mixture composed of one or more than one member of the group consisting of metallic Ca, Mg, Ba and Sr and one or more than one member of the group consisting of calcium halide, magnesium halide, barium halide and strontium halide. The content of the reaction vessel is then heated in an atmosphere of such inert gas as Ar, He, etc. to a temperature within a range which is at or above the melting point of the flux but which is at or below the melting point of the alloy to be treated, and kept at the temperature for a time which may be determined by, or dependent upon, the temperature used, the particle size of the alloy, the velocity of diffusion of P and N and the degree of dephosphorization and denitrification. After cooled, the content is washed with water or with 1 N hydrochloric acid and the alloy treated is separated from the flux.

For example, a commercially available powder of the low carbon ferro-chrome having the particle size of 0.2 mm obtained by mechanical crushing was treated with a flux of 10% Ca metal — 90% $CaCl_2$ at 1100° C for 10 hours according to the above mentioned procedures. As a result, the rate of dephosphorization was found to be 70% or more and the rate of denitrification was found to be 95% or more. There was no loss of chromium.

The method of this invention makes it possible to simultaneously effect dephosphorization and denitrification in the presence of a reducing flux, whereby there is no loss of valuable elements, which has not been encountered in the prior art.

The flux used in the method of this invention is highly corrosive. For this reason, a general non-metallic refractory vessel such as of $Al_2O_3$, MgO and the like can not be used, although a metallic vessel such as of Fe, Ta, Mo, W and the like is not corroded. In view of the fact such metallic vessel is used as a reaction vessel, an alloy to be treated should be in a solid phase. Accordingly, it is necessary to keep the treatment temperature below the melting point of the alloy to be treated.

According to the results of experiments conducted by the inventors, it has been found that there is some fluctuation in the distribution and the diffusion behavior of phosphorus in the interior of the particle, depending upon a particular method used for making powders. In the case of the alloy powders obtained by mechanical crushing, the crystals grains inside the particles are relatively large and the phosphorus is also distributed uniformly therein. The elimination of phosphorus according to this invention is governed by the velocity of diffusion of phosphorus in the particles. Accordingly, it is preferable to elevate the treatment temperature as high as possible in order to accelerate the reaction and shorten the treatment hours. As contrasted to the mechanical crushing, in the powder which has been solidified by rapid cooling as in the atomizing process, the crystal grains inside the particles have been made fine and the phosphorus is segregated along the boundary of the fine crystal grains. It has now been found that when the temperature of the alloy powder thus obtained where phosphorus has been segregated is rapidly increased from a temperature range where the crystal grain can not be coarsened such as a room temperature to a treatment temperature by a rate of at least 1000° C/15 min., phosphorus can be eliminated for a comparatively shorter time. For instance, the low carbon ferro-chrome powder which has been crushed by atomizing process using water jet and where phosphorus has been segregated in the boundary of the fine crystal grains was thrown into a molten flux of 10% Ca metal — 90% $CaCl_2$ which has preliminarily been kept molten at a treatment temperature of 1000° C. The low carbon ferro-chrome powder thus thrown reached to the treatment temperature of 1000° C in 10 minutes. As a result, the degree of dephosphorization of 96% was obtained in a 30-minute treatment. It demonstrates that phosphorus segregated in the boundary of the fine crystal particles was eliminated by diffusion through the grain boundary, taking advantage of the fact that the diffusion through the grain boundary is faster than the diffusion inside the grain.

In order to effectively remove phosphorus by utilizing the diffusion through the grain boundary as stated above, it is necessary to elevate the temperature of an alloy to be treated where phosphorus has been segregated in the boundary of the fine crystal grains to a treatment temperature for a time which is short enough to prevent the coarsening of the crystal grains in the course of the temperature increase.

If the rate of the increase of temperature is slower than 1000° C/15 min., the coarsening of the crystal grains occurs in the course of the temperature increase whereby phosphorus segregated in the boundary of the original fine crystal grains remains as it is distributed inside the grains. In this case, the elimination of phosphorus is governed by the diffusion velocity inside the grains and the velocity of dephosphorization becomes slow.

It has also been found that the elimination of nitrogen is governed by the diffusion velocity of nitrogen inside the grains and independent of the particular method for making powder and the velocity of the temperature increase. For this reason, it is desirable that in order to effect denitrification for a shorter time, the treatment temperature should be as high as possible.

The studies made by the inventors of this invention show that the effect of dephosphorization and denitrification of Cr alloy, Mn alloy, Mo alloy, etc. with the metallic Ca, Mg, Ba or Sr in the molten state or in the vaporized state can also be observed. In these cases, however, there are disadvantages that a great deal of the metals Ca, Mg, Ba and Sr must be required in order to obtain better contact between the alloy to be treated and the molten or vaporized Ca, Mg, Ba and Sr, and that the reaction is delayed because the reaction product adheres to the surface of the alloy. On the contrary, according to this invention, the reaction product can be easily dissolved in the molten flux and thus there is no fear of obstacle to the reaction. In addition, the treatment can be done by a small amount of the metallic Ca, Mg, Ba and Sr.

The ratio of mixing of the flux with the alloy to be treated varies with a process used, for example, a standing process for treating the flux and the alloy in a metallic crucible or other container without moving the same, or a mixing process for treating the flux and the alloy while moving the same by stirring or the like. In case of the standing process, the flux should be in an amount enough for the alloy to be submerged into the flux. In the case of the mixing process, the flux in an amount of at least 5% by volume of the alloy will suffice. In either case, however, it is necessary that the total amount of the metallic Ca, Mg, Ba and Sr in the flux should be at least five times the amount of P and N in the alloy. Moreover, in the case where the flux contains water or such impurities as FeO, $SiO_2$, P, N and the like which react with the above metallic Ca, Mg, Ba and Sr, an extraneous amount of metallic Ca, Mg, Ba and Sr which is enough to react with such substances must be added.

As for the halide to be used, any of the chloride, fluoride, bromide and iodide can be used. Above all, the chloride and the fluoride are preferable in view of their wide adaptability.

As described hereinabove, this invention concerns a treatment of an alloy under solid state by means of a flux containing one or more than one member of the group consisting of metallic Cr, Mg, Ba and Sr and one or more than one member of the group consisting of calcium halide, magnesium halide, barium halide and strontium halide at temperatures not less than the melting point of the flux but not more than the melting point of the alloy, whereby P and N are effectively and simultaneously removed without loss of any alloying component. Consequently, this invention contributes a great deal to an industry of the field mentioned above.

Table 1

| Composition of Flux | Flux(Kg)/Alloy(Kg) | Treatment time (hr) | Low Carbon Ferro-chrome APS 0.2mm DP | DN | APS 0.5mm DP | DN | APS 1.0mm DP | DN | Low Carbon Ferro-manganese APS 0.5mm DP | DN | APS 1.0mm DP | DN | Ferro-molybdenum APS 1.0mm DP | DN | Co-base Alloy APS 0.3mm DP | DN |
|---|---|---|---|---|---|---|---|---|---|---|---|---|---|---|---|---|
| 6%Ca-94%$CaCl_2$ | 0.4 | 10 | 47% | 98% | 28% | 98% | 13% | 98% | 18% | 95% | | | | | 35% | 98% |
| 6%Ca-83%$CaCl_2$-11% $CaF_2$ | 0.4 | 10 | | | 24% | 95% | | | | | 5% | 98% | | | 32% | 98% |
| 5%Mg-95%$MgCl_2$ | 0.4 | 10 | 40% | 98% | 20% | 92% | | | 21% | 93% | | | 15% | 60% | 29% | 98% |
| 10%Ba-90%$BaCl_2$ | 0.4 | 10 | | | | | 12% | 60% | | | 11% | 58% | 13% | 60% | 28% | 98% |
| 10%Sr-90%$SrCl_2$ | 0.4 | 10 | | | | | 12% | 59% | | | 11% | 59% | 13% | 59% | 28% | 97% |
| 4%Ca-2%Mg-40%$CaCl_2$-54%$MgCl_2$ | 0.2 | 10 | | | 21% | 93% | | | 20% | 93% | | | 14% | 60% | 27% | 97% |
| 4%Ca-4%Ba-40%$CaCl_2$-52% $BaCl_2$ | 0.2 | 20 | | | 27% | 95% | | | | | 18% | 85% | 20% | 90% | 30% | 97% |

APS: Average diameter of particle
DP: Rate of dephosphorization
DN: Rate of denitrification
Treatment temperature: 1000° C
Atmosphere: Ar gas, 1 atm.

Table 2

| Composition of flux | Flux Kg per alloy Kg | Treatment hour (hr) | Treatment temperature °C | Average particle size 0.3mm De-P | De-N | 0.5mm De-P | De-N | 1.0mm De-P | De-N |
|---|---|---|---|---|---|---|---|---|---|
| 10%Ca-90%$CaCl_2$ | 0.4 | 0.5 | 900 | 94% | 70% | 96% | 58% | | |
| 10%Ca-90%$CaCl_2$ | 0.4 | 1.0 | 900 | | | 97% | 62% | | |
| 10%Mg-90%$HgCl_2$ | 0.5 | 0.5 | 1000 | 95% | 97% | | | 93% | 65% |

Atmosphere: Ar 1 atm.
De-P: Degree of dephosphorization
De-N: Degree of denitrification Typical examples of this invention are described below.

EXAMPLE 1

A low carbon ferro-chrome powder manufactured by atomizing process (62.1% Cr, 0.09% C, 0.021% P, 0.049% N, 0.72% Si), a low carbon ferro-manganese powder obtained by crushing (81% Mn, 0.08% C, 1.0% Si, 0.28% P, 0.082% N), a ferro-molybdenum powder (63.5% Mo, 0.89% Si, 0.037% P, 0.089% S, 0.4% Cu, 0.04% N) and a Co-base alloy powder (0.12% C, 1.5% Mn, 1.0% Si, 20% Cr, 10% Ni, 51% Co, 15% W, 0.03% P, 0.03% N) were treated in a pure iron crucible at 1000° C by the use of a flux according to this invention.

The condition and the result are shown in Table 1. Analysis made after this treatment demonstrates that S, O, Sn, As, Sb, Pb and Bi can also be removed simultaneously. In this Example, the rate for elevating the temperature of the alloy powder was 1000° C/hour.

EXAMPLE 2

1 Kg of a low carbon ferro-chrome powder (60% Cr, 0.05% C, 0.028% P, 0.12% N) which has been manufactured by atomizing process and where phosphorus has been segregated along the boundary of the crystal grains was thrown into a flux of this invention which has preliminarily been melted and kept at a temperature of 900° C or 1000° C under argon atmosphere. The temperature of the ferro-chrome powder was thus rapidly increased. When the ferro-chrome powder was thrown into said flux, it was continuously thrown at a rate of 100 g/min. so that the temperature increase of the ferro-chrome alloy became faster than 1000° C/5min.

The test conditions and the result are shown in Table 2. Analysis after treatment shows that S and O could also be eliminated.

We claim:

1. A method for removing phosphorus and nitrogen from an alloy containing easily oxidizable components which comprises bringing the alloy in the solid phase thereof into contact with a flux composition comprising a. at least one member selected from the group consisting of metallic Ca, Mg, Ba and Sr, and b. at least one member selected from the group consisting of calcium halide, magnesium halide, barium halide and strontium halide at a temperature not less than the melting point of said flux composition but not more than the melting point of said alloy.

2. A method in accordance with claim 1 wherein the alloy is in powder form.

3. A method in accordance with claim 2 wherein the temperature of the alloy is increased from a temperature where the coarsening of crystal grains does not occur to a temperature not less than the melting point of said flux composition but not more than the melting point of said alloy at a rate of at least 1000° C/15 min. before contacting same with said flux composition.